US006281165B1

(12) United States Patent
Cranford

(10) Patent No.: US 6,281,165 B1
(45) Date of Patent: Aug. 28, 2001

(54) THEROCHROMATIC INK COVERED ARTICLE HAVING IMAGE DISPOSED THEREON AND METHOD OF MAKING THE SAME

(75) Inventor: Gary Cranford, Covington, TN (US)

(73) Assignee: World Wide Art Studios, Covington, TN (US)

( * ) Notice: Subject to any disclaimer, the term of this patent is extended or adjusted under 35 U.S.C. 154(b) by 0 days.

(21) Appl. No.: 09/239,833

(22) Filed: Jan. 29, 1999

(51) Int. Cl.[7] ..... B41M 5/035; B41M 5/38; B41M 5/40

(52) U.S. Cl. ..... 503/226; 427/150; 427/152; 428/29; 503/200; 503/227

(58) Field of Search ..... 428/1, 29, 913; 8/471; 503/227, 200, 226; 427/150, 152

(56) References Cited

U.S. PATENT DOCUMENTS

| | | | | |
|---|---|---|---|---|
| 4,156,365 | | 5/1979 | Heinmets et al. | 73/343 B |
| 4,554,565 | | 11/1985 | Kito et al. | 346/201 |
| 4,716,145 | * | 12/1987 | Hess | 503/227 |
| 4,725,462 | | 2/1988 | Kimura | 428/29 |
| 4,853,256 | | 8/1989 | Obringer et al. | 427/152 |
| 4,888,219 | | 12/1989 | Barnes | 428/1 |
| 4,919,983 | | 4/1990 | Fremin | 428/35.7 |
| 5,219,625 | | 6/1993 | Matsunami et al. | 428/30 |
| 5,223,958 | | 6/1993 | Berry | 359/43 |
| 5,489,567 | * | 2/1996 | Koshizuka et al. | 503/227 |
| 5,688,592 | | 11/1997 | Shibahashi et al. | 423/323 |
| 5,809,590 | | 9/1998 | Williams et al. | 4/661 |
| 5,820,951 | | 10/1998 | Osborne | 428/29 |

FOREIGN PATENT DOCUMENTS

| | | | |
|---|---|---|---|
| WO 98/57760 | 12/1998 | (WO) | B05D/5/06 |

* cited by examiner

*Primary Examiner*—Bruce H. Hess
(74) *Attorney, Agent, or Firm*—Nixon & Vanderhye PC; Frank P. Presta

(57) ABSTRACT

A thermochromatic ink covered article including a substrate, a thermochromatic ink layer disposed on the substrate, a polymer acrylic protective coating over said thermochromatic ink layer, and a design disposed at least partially in said protective coating, the design being transferred to the protective coating via a sublimation ink transfer process.

16 Claims, 1 Drawing Sheet

THEROCHROMATIC INK COVERED ARTICLE HAVING IMAGE DISPOSED THEREON AND METHOD OF MAKING THE SAME

The present invention is directed to an improved thermochromatic ink covered article, and particularly, to a thermochromatic ink covered article having an acrylic coating and an image visible on the acrylic coating, and a method of making the same.

BACKGROUND OF THE INVENTION

It is known to coat an article such as, for example, a mug, kettle or dish with thermochromatic ink such that when the article undergoes a temperature change by, for example, hot liquid being poured thereinto, an image disposed on the article becomes visible as the thermochromatic ink becomes transparent, and when the article cools, the image "disappears." Also known are thermochromatic inks that change from opaque to transparent as its temperature changes from hot to cold. With such inks, images can be made to "disappear" when the article is heated.

U.S. Pat. No. 5,223,958 to Berry describes a well-known article that incorporates thermochromatic ink in an amusement device that is heat activated. Berry's amusement device comprises a supporting substrate, a layer of micro encapsulated thermochromatic liquid crystal material disposed on the substrate and an outer transparent film having a message or visual image thereon. The requirement of a separate layer to carry the image, however, contributes to increased manufacturing costs in terms of both materials and process steps. Moreover, the Berry reference fails to provide any sort of protection for the transparent film. That is, the transparent film easily can be damaged by scratching or the like. Moreover still, an article manufactured in accordance with the disclosure of Berry is deficient in that no protection is afforded when the article is subjected to relatively harsh conditions, such as those presented by an automatic dishwasher.

U.S. Pat. No. 5,219,625 to Matsunami et al. is similar to Berry and discloses a thermochromatic laminate member having a base layer, a thermochromatic layer, and a thin transparent iridescent film laminated on the thermochromatic layer. Color patterns on the film become visible once the thermochromatic layer becomes clear after heating. An article fabricated in accordance with Matsunami et al., however, like an article made in accordance with Berry, requires a separate transparent film over the thermochromatic ink and, further, is susceptible to harsh conditions, wherein the laminate and even the thermochromatic ink layer can be damaged.

SUMMARY OF THE INVENTION

It is therefore an object of the present invention to provide a thermochromatic ink covered article with an image thereon that is relatively inexpensive to manufacture and can withstand wear and tear including the wear and tear associated with an automatic dishwasher.

It is a further object of the present invention to simplify the process of manufacturing a thermochromatic ink covered article by eliminating the step of positioning and disposing a transparent film over a thermochromatic ink layer.

It is another object of the present invention to provide a thermochromatic ink covered article having an image disposed thereon via sublimation ink transfer.

In a preferred embodiment of the present invention, a thermochromatic ink covered article includes a substrate such as a mug or glass, a thermochromatic ink layer disposed on the substrate, a protective coating, preferably polymer acrylic, over the thermochromatic ink layer, and a design disposed at least partially in the protective coating so that it is visible when the thermochromatic ink is heated or disappears when cooled.

Preferably, the design is incorporated with the protective layer via sublimation inks and related processes.

To simplify manufacture, both the thermochromatic ink layer and protective layer preferably are sprayed onto the substrate. Further, to enhance the adhering properties of the sprayed thermochromatic ink, a mixture preferably is preliminarily prepared that includes the thermochromatic ink along with a base medium and a catalyst.

A preferred method of manufacturing the thermochromatic ink covered article in accordance with the present invention includes spraying thermochromatic ink on a substrate to produce a thermochromatic ink layer on the substrate, thereafter coating, via spraying, the thermochromatic ink layer with a protective coating that preferably comprises polymer acrylic, and applying a design to the protective coating, preferably via a sublimation transfer process, silk screen or fired ceramic decal.

The method preferably further includes washing, drying and heating the article prior to at least one of the spraying and coating steps, and curing the article after the thermochromatic ink spraying step. Additionally, the method of the present invention includes drying the article after the coating step.

In accordance with the present invention, a durable and relatively simple to manufacture thermochromatic ink covered article is provided; durable because the design is for all practical purposes permanently bonded with the polymer acrylic protective layer thereby making both the thermochromatic ink layer and design "dishwasher safe," and simple to manufacture because of the relatively simple spraying and sublimation transfer steps.

BRIEF DESCRIPTION OF THE DRAWINGS

The present invention will be more fully understood upon reading the following Detailed Description in conjunction with the accompanying figures, in which reference numerals are used consistently to indicate like elements, and in which.

DETAILED DESCRIPTION OF THE INVENTION

The present invention provides an improved thermochromatic ink covered article and a process for making the same. Specifically, in accordance with the present invention there is provided a mug, glass or any other article that can withstand temperature changes and that is capable of "hiding" a design within a thermochromatic material disposed on the article and is capable of making the design appear when a hot beverage, for example, is poured into the article. Alternatively, the present invention provides an article that is capable of showing a design at room temperature, but hides the design when a cold beverage, for example, is poured into the article, thereby cooling the article. It is to be understood that while the preferred embodiment discussed herein is directed to a mug or glass, the present invention is applicable to any container into which liquids of varying temperatures can be added, such as a pot. Indeed, the present invention also is applicable to any article that undergoes temperature changes and on which it might be desirable to place a design or image that appears or disappears in accordance with changes in temperature.

Figure 1:
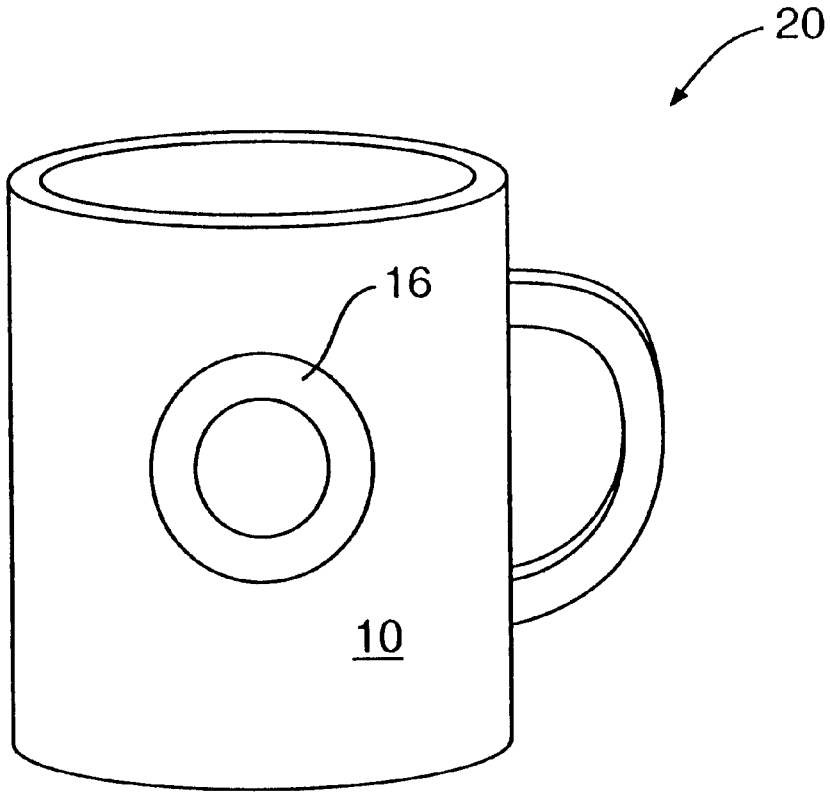
FIG. 1 is a perspective view of an article having an image disposed thereon in accordance with the present invention.
Figure 2:
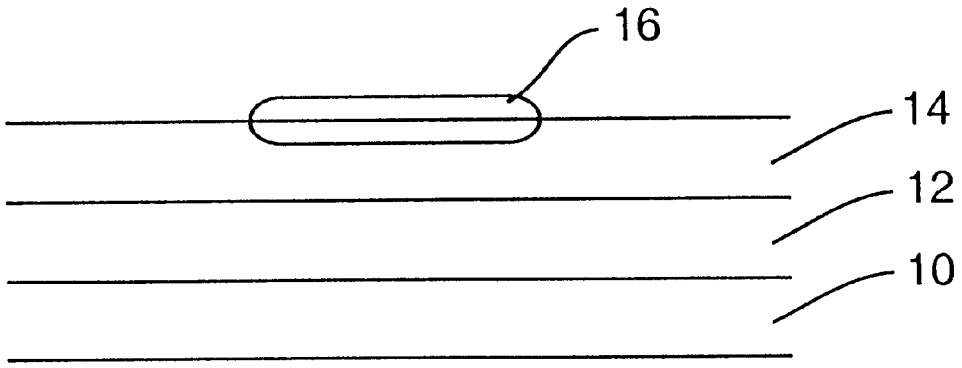
FIG. 2 is a schematic cross sectional view of the plurality of materials comprising the structure of the present invention.

A preferred embodiment of the present invention will now be described with reference to FIGS. 1 and 2. FIG. 1 is a perspective view of a mug 20 having an image disposed thereon in accordance with the present invention and FIG. 2 illustrates schematically a cross sectional view of the plurality of materials comprising the structure of the present invention.

In accordance with the present invention, a thermochromatic ink, containing polymers of epichlorohydrin is prepared in a base medium such as Butoxyethanol and Methyl Pyrrolidone, which provides a viscosity suitable for spraying, using either conventional methods or electrostatic methods. Just prior to a spraying step (described below), a catalyst, such as Glycidyloxypropyl is added to the thermochromatic ink mixture to enhance the mixture's adhering properties.

Mug 20 is first washed and dried in preparation for spraying. Mug 20 is then heated to approximately 110° F. to 135° F. and then routed through a spray booth wherein the above-described thermochromatic ink mixture is sprayed onto mug 20, and, more specifically, as shown in FIG. 2, on an outer surface 10 of mug 20. Mug 20 preferably is then subjected to a curing process at a temperature of about 395° F. to 525° F. for approximately 15 to 30 minutes. At the end of the curing period, mug 20 is coated externally with a properly adhered thermochromatic ink layer 12 and, accordingly, exhibits the color of the thermochromatic ink/base medium mixture. While layer 12 is substantially permanent on surface 10, it is not sufficiently durable to withstand the conditions that may be experienced in an automatic dishwasher.

To make the mug 20 dishwasher safe another coating, preferably polymer acrylic, is applied over thermochromatic ink layer 12. Specifically, mug 20 preferably is again washed, dried and heated to approximately 110° F. to 135° F. to prepare same for another spraying step. In this second spraying step, a one part polymer acrylic mixture, such as Xylene and Butyl Di Ethoxol, is prepared and sprayed to completely cover the mug 20 and the thermochromatic ink layer 12, previously applied. In the preferred embodiment of the present invention the material used for the second spraying step does not require a catalyst. However, a catalyst could be added if it is deemed desirable. It is noted also that while polymer acrylic has been described above, any material that can provide the desired protection layer is within the scope of the present invention. The sprayed-on polymer acrylic material preferably is then dried in an oven for 15 to 30 minutes at 395° F. to 525° F. Once hardened, a protective layer 14 is set-up over thermochromatic ink layer 12 and provides the desired dishwasher proof protection for the thermochromatic ink layer 12. The protective layer 14 further provides a glossy appearance to mug 20 and still further provides a surface on which a decorative pattern or image can be applied, as described below.

Further in accordance with the present invention, a design 16 is incorporated with protective coating layer 14. Preferably, a design is created on a piece of paper using sublimation inks, either through known electronic copying systems or offset printing processes. This step results in a well-known paper transfer. Preferably, the design is printed in reverse so the sublimation ink can be applied directly to the exposed surface of protective layer 14. In a preferred embodiment of the present invention, the paper transfer is applied with sufficient pressure at a temperature of approximately 395° F. to 525° F. for about 5 to 15 minutes. During this time, the sublimation inks vaporize and transfer from the paper into the protective layer 14, as shown in FIG. 2. The resulting bond is, for all practical purposes, permanent. In accordance with the present invention, an image or design can be transferred into layer 14 in any area of the mug 20 on which layer 14 is coated. Additionally, it is possible to dispose a desired design on mug 20 via silk screening or fired ceramic decal.

Once the transfer process is complete and mug 20 cools to room temperature, any colors incorporated into the transferred design become substantially hidden. However, when a hot liquid is poured into the mug 20, the thermochromatic ink layer 12 becomes transparent and the transferred design 16 becomes bright and sharp to a viewer. Four-color process designs are particularly vivid when implemented in the present invention.

If a thermochromatic material that is transparent at room temperature and opaque at cold temperatures is used, then the thermochromatic ink layer 12, after curing, will be clear or transparent. The protective layer 14 is applied in the same manner as detailed above, as is the design 16. However, instead of the design 16 being hidden at room temperature, the design 16 is visible at such temperatures. When mug 20 is chilled by, for example, adding a cold beverage, the design is partially or, depending on the color of the design 16, entirely hidden from view.

In accordance with the present invention the sprayed on protective coating layer 14 provides a dishwasher safe coating for the thermochromatic ink-covered article and further provides a simple receptor for the sublimation inks comprising the design 16. Thus, there is no need for alignment procedures such as would be necessary for the design-carrying films of the prior art. Nor is there a concern that such design-carrying films will be damaged under expected handling of the article, including the likelihood of the article being placed in an automatic dishwasher. That is, since the sublimation inks are incorporated into the relatively durable protective coating layer 14, the design 16 is virtually permanently adhered to the article. Consequently, the structure of the present invention provides numerous advantages over prior art thermochromatic ink carrying articles.

The present invention has been described in terms of presently preferred embodiments so that an understanding of the present invention can be conveyed. The present invention should therefore not be seen as limited to the particular embodiments described herein. Rather, all modification, variations, or equivalent arrangements that are within the scope of the attached claims should be considered to be within the scope of the invention.

What is claimed is:

1. A thermochromatic ink covered article, comprising:

a substrate;

a thermochromatic ink layer disposed on said substrate;

a protective coating over said thermochromatic ink layer; and a design disposed at least partially in said protective coating.

2. The article of claim 1, wherein said protective coating comprises a sprayable polymer acrylic.

3. The article of claim 1, wherein said design comprises sublimation ink.

4. The article of claim 1, wherein thermochromatic ink layer comprises a base medium and a catalyst.

5. The article of claim 1, wherein said substrate comprises a vessel for holding fluid.

6. the article of claim 5, wherein the article is one of a mug, a cup, a glass, and a pot.

7. A method of manufacturing a thermochromatic ink covered article, comprising the steps of:

spraying thermochromatic ink on a substrate to produce a thermochromatic ink layer on said substrate;

coating said thermochromatic ink layer with a protective coating; and applying a design to at least an exposed surface of said protective coating so that it is disposed at least partially therein.

8. The method of claim 7, further comprising washing, drying and heating the article prior to at least one of said spraying and coating steps.

9. The method of claim 7, further comprising mixing said thermochromatic ink with a base medium and a catalyst prior to said spraying step.

10. The method of claim 7, further comprising curing the article after said spraying step.

11. The method of claim 7, further comprising drying the article after said coating step.

12. The method of claim 7, wherein said applying step comprises a sublimation ink transfer process.

13. The method of claim 12, wherein said sublimation ink transfer process comprises applying a transfer paper having said design thereon to an exposed surface of said protective coating under a predetermined pressure and temperature.

14. The method of claim 13, wherein the predetermined pressure and temperature are applied for about 5 to 15 minutes.

15. The method of claim 7, wherein said coating step comprises spraying a polymer acrylic.

16. The method of claim 7, wherein said applying step comprises at least one of applying a silk screen and fired ceramic decal.

* * * * *